US007033212B1

(12) United States Patent
Vilarchao et al.

(10) Patent No.: US 7,033,212 B1
(45) Date of Patent: Apr. 25, 2006

(54) POWER DISCONNECT APPARATUS AND METHOD FOR AN APPLIANCE SUPPORTED BY A SECONDARY SUPPORT

(75) Inventors: Vincent Vilarchao, Florence, SC (US); Robert F. Deaver, II, McColl, SC (US); Carl Phillip Hinesley, Pinehurst, NC (US)

(73) Assignee: Marley Engineered Products, Bennettsville, SC (US)

( * ) Notice: Subject to any disclaimer, the term of this patent is extended or adjusted under 35 U.S.C. 154(b) by 0 days.

(21) Appl. No.: 10/958,383

(22) Filed: Oct. 6, 2004

(51) Int. Cl.
*H01R 13/60* (2006.01)

(52) U.S. Cl. ..... 439/576; 439/180

(58) Field of Classification Search ..... 439/576, 439/923, 536, 180, 258, 474; 362/403, 404, 362/407
See application file for complete search history.

(56) References Cited

U.S. PATENT DOCUMENTS 2,374,823 A * 5/1945 Leib et al. ..... 174/42
6,676,375 B1 * 1/2004 Steeves LeBlanc et al. .... 416/5
6,734,680 B1 * 5/2004 Conard ..... 324/509

FOREIGN PATENT DOCUMENTS

JP 5-157092 * 6/1993

* cited by examiner

*Primary Examiner*—P. Austin Bradley
*Assistant Examiner*—Phuongchi Nguyen
(74) *Attorney, Agent, or Firm*—Baker & Hostetler LLP

(57) ABSTRACT

An electrical appliance includes a mount configured to mount an appliance to a support structure a support cable configured to have a slack position and a slack position; an electrical wiring configured to provide an electrical connection between a power consuming portion of the appliance and an external source. An electrical appliance also includes an electrical connection providing power to the power consuming part of the appliance when the cable is in a slack position and the electrical connection is not configured to not provide an electrical connection to the power consuming part of the appliance when the cable is in the tension position. A method to cutting off power to an appliance is also described.

21 Claims, 3 Drawing Sheets

POWER DISCONNECT APPARATUS AND METHOD FOR AN APPLIANCE SUPPORTED BY A SECONDARY SUPPORT

FIELD OF THE INVENTION

The present invention relates generally to supporting electrical appliances that are suspended above a floor. More particularly, the present invention relates to electrical appliances suspended above a floor having a secondary support means and an electrical cut off when the secondary support means is engaged.

BACKGROUND OF THE INVENTION

In many applications it is desirable to suspend electrical appliances above the floor. For example, ceiling fans and lights are often mounted in ceilings. Similarly, speakers and other electrical power consuming appliances may be mounted in a building and supported by some other support structure than a floor. Occasionally, the mounting means for supporting these appliances such as brackets, J-hooks, screws and bolts or whatever mounting means is used to secure the appliances may fail.

Should the support means fail, to avoid the undesirable effects of the appliance falling, a secondary support means may be incorporated into the appliance. If the primary means of support fails, the second support means may engage and support the appliance before it falls all the way to the ground. Further, some government regulations agencies, and standard setting originations may require certain classes of appliances to have a secondary support.

In some instances, the primary support means may fail, and the appliance may be supported by the secondary support means, yet, still receive power and continue to operate. For example, lights, speakers, ceiling fans may continue to operate despite the fact that the primary support means has failed and are now being supported by a secondary support means. In many instances, it may be desirable to have the electrical appliance no longer operate when it is being supported by the secondary support means. The fact that the appliance has stopped may alert appliance users or maintenance personal that the appliance is in need of service.

Accordingly, it is desirable to provide a method and apparatus that provides a secondary support means for an electric power consuming appliance and an electric power cut off rendering the appliance inoperable when a primary support means fails and the appliance is being supported by the secondary support means.

SUMMARY OF THE INVENTION

The foregoing needs are met, to a great extent, by the present invention, wherein in one aspect an apparatus and method is provided that in some embodiments provides a secondary support means for an electrical appliance and a cut-off that cuts off electrical power to the appliance when the appliance is being supported by a secondary support means.

In accordance with one embodiment of the present invention, an electrical appliance is provided. The electrical appliance includes a mount configured to mount the appliance to a support structure; a support cable configured to have a slack position and a tensioned position, the cable having an end proximate to the mount and another end configured to support the appliance when the cable is in the tensioned position; electrical wiring running substantially along the length of the cable and configured to provide an electrical connection between an energy consuming portion of the appliance and an external source; and an electrical connection located within the electrical wiring configured to provide an electrical connection to the power consuming part of the appliance wherein the cable is in the slack position, and the electrical connection is configured to not provide an electrical connection to the power consuming part of the appliance when the cable is in the tensioned position.

In accordance with another embodiment of the present invention, an electrical appliance is provided. The electrical appliance comprises means for mounting configured to mount the appliance to a support structure; flexible elongated secondary supporting means configured to have a slack position and a tensioned position and having an end proximate to the mounting means and another end configured to support the appliance when the secondary supporting means is in the tensioned position; means for transmitting electrical power running substantially the length of the secondary support means and configured to provide an electrical connection between an energy consuming portion of the appliance and an external source; and means for providing an electrical connection to the power consuming part of the appliance located within the means for transmitting electrical power, the electrical connection means configured to provide the electrical connection when the supporting means is in the slack position, and the means for providing an electrical connection is configured to not provide an electrical connection to the power consuming part of the appliance when the supporting means is in the tensioned position.

In accordance with yet another embodiment of the present invention, a method of cutting off power to an appliance is provided. The method comprises supplying the appliance with a secondary support cable and configuring the cable to be slack, when the cable is not supporting the appliance and configuring the cable to be taut when the cable is supporting the appliance; and electrically connecting a power consuming portion of the appliance with a power source when the cable is slack, and breaking the electrical connection when the cable is taut.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
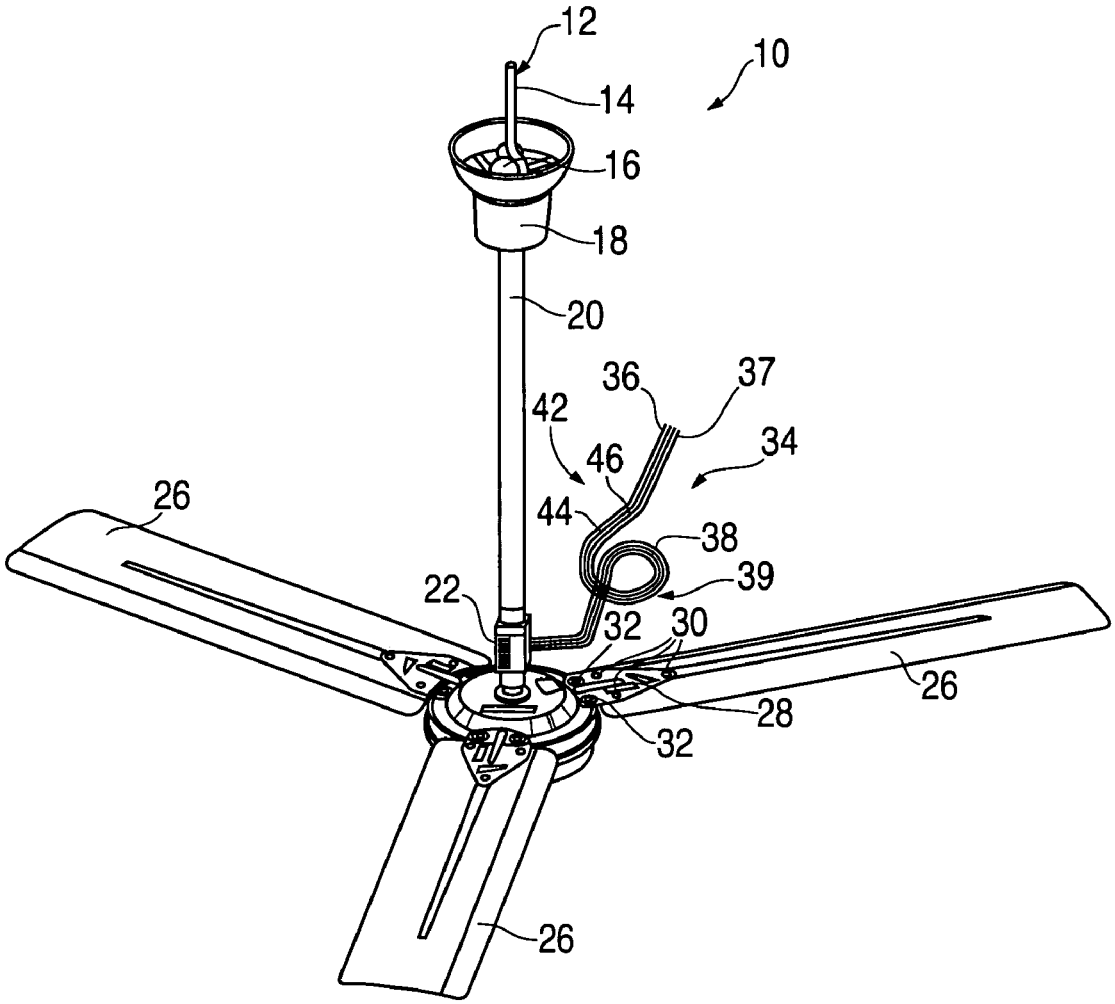
FIG. 1 is a perspective view illustrating an electrical appliance according to a preferred embodiment of the invention.

An embodiment in accordance with the present invention provides an electrical appliance that is mounted to a support structure rather than placed on a floor. The electrical appliance has a primary support and a secondary support. Preferably, the secondary support is a cable that is in a slack position wherein the primary support is being used. Should the primary support fail, the second support will be engaged and will support the appliance. For example, in situations where a cable is used as a secondary support structure, the appliance will fall a small amount taking up the slack in the cable and then will be supported by the cable. When the cable is supporting the appliance, the cable will be in a tensioned position.

In preferred embodiments of the invention, when the appliance is no longer supported by the primary support but by the secondary support, power is cut off to the appliance and the appliance will stop working, and thereby alert appliance users or support personnel that maintenance is required on the appliance.

An exemplary embodiment of the invention will now be described with reference to the drawing figures, in which like reference numerals refer to like parts throughout.

An embodiment of the present inventive apparatus is illustrated in FIG. 1. FIG. 1 illustrates an electrical appliance 10, which in this case is a ceiling fan 10. The ceiling fan 10 is mounted to a ceiling by a J-hook mount 12. The J-hook mount 12 is threaded with threads 14 which allows the J-hook mount 12 to be screwed into a support structure associated with the ceiling such as studs in the ceiling or other suitable structure. In industrial applications, for example, the J-hook may attach to support structure mounted to steel girders in a factory or shop ceiling. The threads 12 may be wood threads for threading into a wooden stud or machine threads to be held in place by screwing into a tapped hole or a nut. The J-hook mount 12 connects to the ceiling fan 10 by a mounting bar 16. A mount housing 18 provides a cover for the J-hook mount 12 and the mounting bar 16. While the embodiment shown uses a J-hook mount 12, other suitable mounting means may also be used. For example, a ball and socket joint system may be used in accordance with the invention.

A hollow down rod 20 extends from the mount housing 18. At one point the down rod 20 is interrupted by a junction box 22 which provides access to wiring contained within the down rod 20 which will be discussed in more detail below. The down rod 20 supports the motor housing 24 which houses an electrical motor contained within the motor housing 24.

According to some embodiments of the invention, fan blades 26 are mounted on the motor housing 24 and connecting to the motor housing 24 via fan blades brackets 28. The fan blade brackets 28 are connected to the fan blades 26 by screws 30. Screws 32 connect the fan blade brackets 28 to the motor housing 24.

Figure 2:
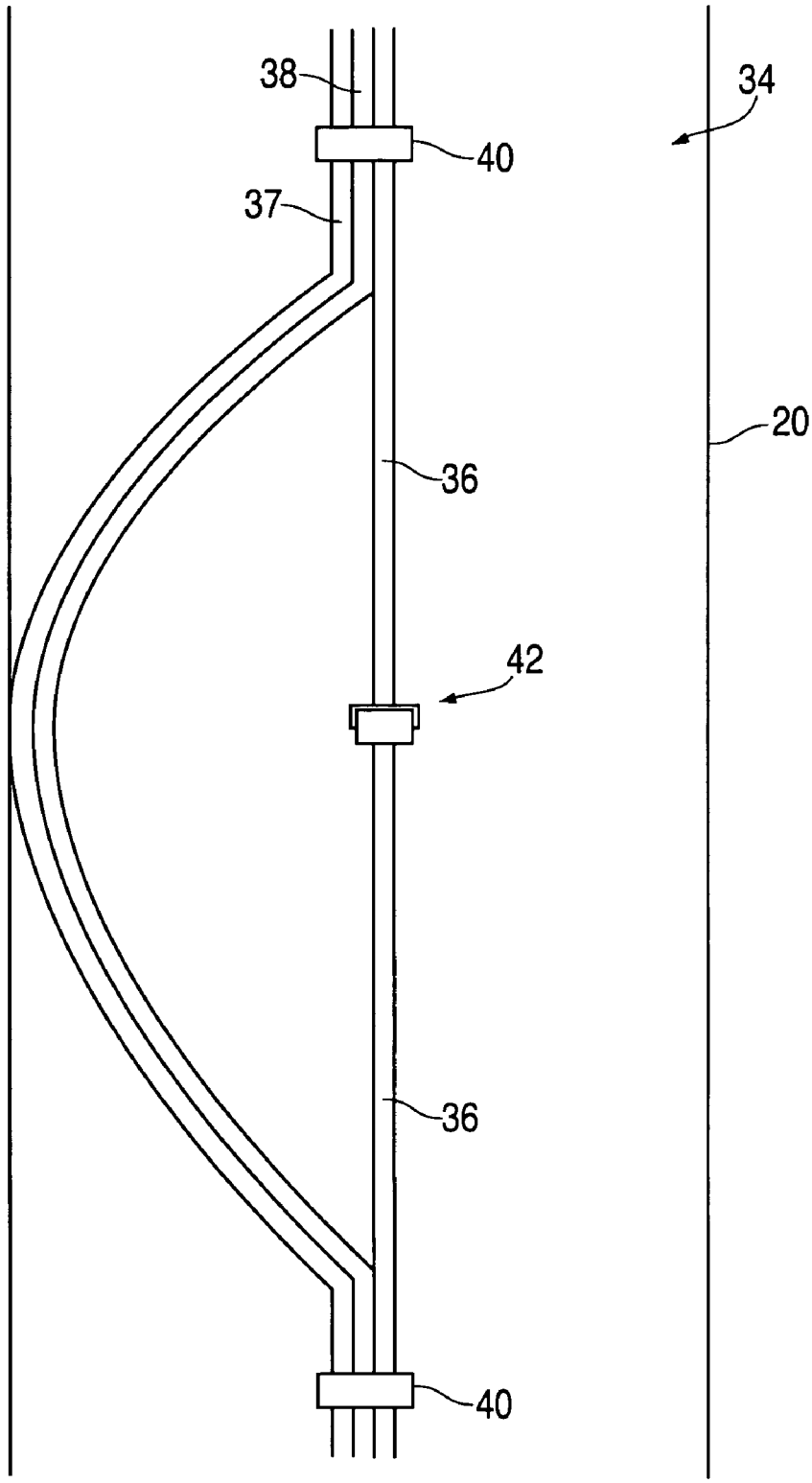
FIG. 2 is a side view of a secondary support cable and electrical connection in accordance to a preferred embodiment of the invention when the electrical connection is made and the support cable is in a slack position.
Figure 3:
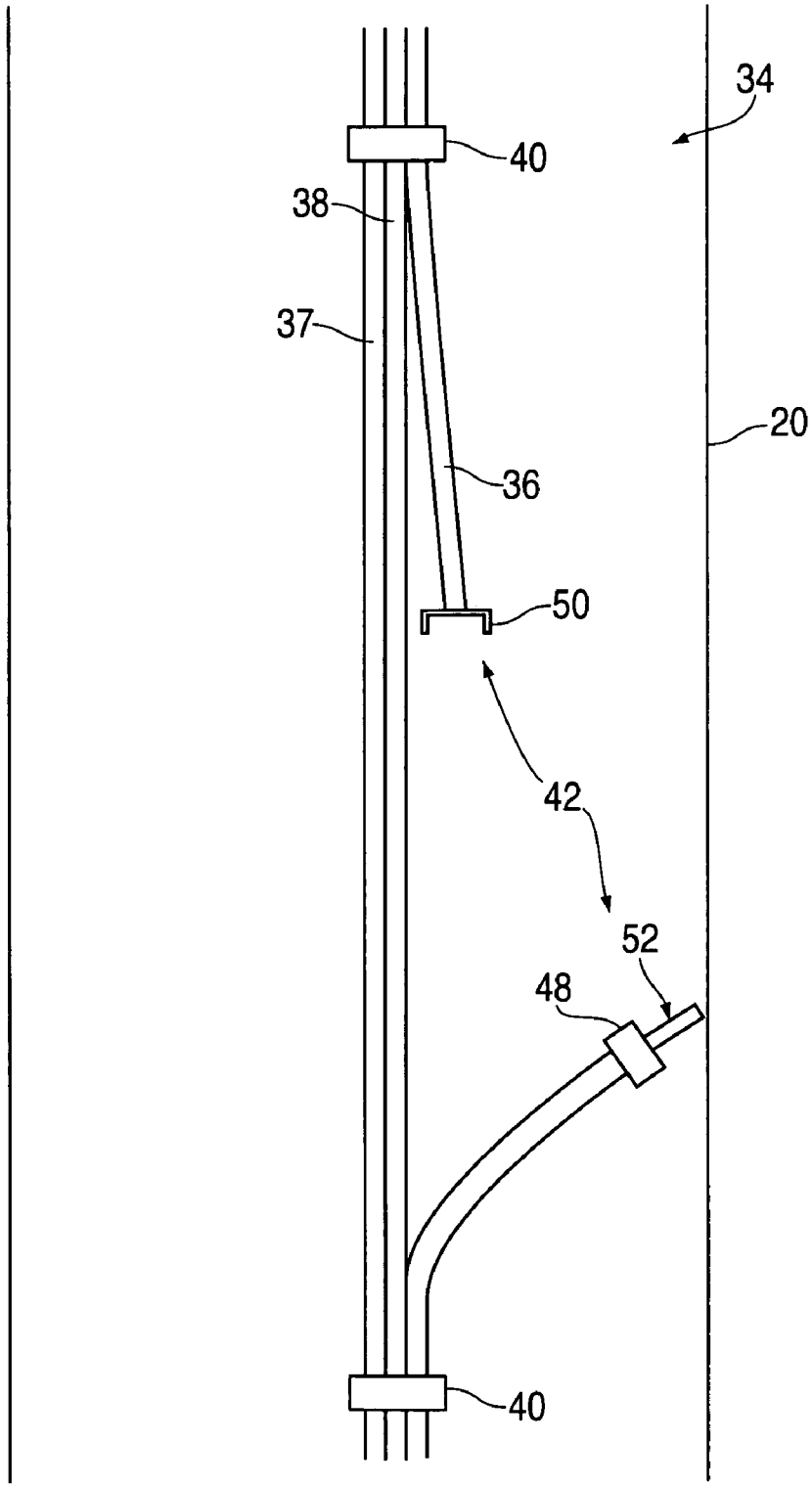
FIG. 3 is a side view of the support cable in the electrical connectors according to a preferred embodiment of the invention wherein the support cable is in a tension position and the electrical connection is broken and no power is provided to the appliance.

A wire assembly 34 is shown extending from the junction box 22. This is done in FIG. 1 for illustrative purposes, but in practice the wire assembly 34 will be contained within the down rod 20 as shown in FIGS. 2 and 3. The wire assembly 34 includes a secondary support cable 38. The secondary support cable 38 has a loop 39 which is exaggerated in size for illustrative purposes in FIG. 1. In other embodiments of the invention, the support cable 38 is not looped but rather is slacked in some other manner such as illustrated in FIGS. 2 and 3. Alternatively, the support cable 38 may be slacked in some other suitable manner.

The support cable 38 terminates at one end in the mount housing 18. The terminal end is configured to mechanically connect to the support structure and provide a secondary support for the appliance 10 apart from the primary support (in the embodiment shown, a J-hook support 12). The other end of the support cable 38 is connected to the motor housing 24 or alternatively some other structure configured to cause the appliance 10 to stay mechanically connected to the ceiling via the support cable 38 should the primary support 12 fail.

In some embodiments of the invention, the wire assembly 34 includes wire harnesses 36 and 37. Wire harnesses 36 and 37 have one end terminating in the mount housing 18 and are configured to connect to an external power source and/or an electric ground associated with the support structure. The other end of the wire harnesses 36 and 37 are electrically connected to the electric motor contained within the motor housing 24. Thus, the wire harnesses 36 and 37 can, in certain conditions provide electric power and/or grounding, to the power consuming portion of the appliance 10 (in the embodiment shown, a motor).

Running along side the support cable 38 are wires 37 that do not disconnect when the support cable 38 becomes tensioned. For example, wire 37 may be the ground wire that provides grounding for the appliance 10.

As a part of the wire assembly 34 that does disconnect upon tensioning of the support cable 38 there is an electrical wire harness 36 that has a connection 42 (shown in FIGS. 2 and 3). The wire harness 36 has much less slack in it than the support cable 38 and the non-separating wire connection 37.

The wire assembly 34 will now be described in more detail as shown in FIGS. 2 and 3.

Turning now to FIG. 2, an illustrative embodiment of the invention is shown where the wire assembly 34 is configured to provide power to the appliance 10. As shown in FIG. 2, the wire assembly 34 is contained within the down rod 20. The support cable 38 is shown in position having slack and running along side of the support cable 38 is a non-separating electric wire harness 37. The wire harness 37 that may be comprised of one or several wires. A second wire harness 36 is also shown. Wire harness 36 is configured to break or separate at a connection 42 under certain conditions. Both wire harnesses 37 and 36 are clamped to the support cable 38 by clamps 40. In other embodiments of the invention, only one of the wire harnesses 36 and 37 is clamped to the support cable 38.

Should the primary support for the appliance 10 fail, the appliance 10 will start to fall and remove the slack in the support cable 38. The non-separating wire harness 37 will also have the slack in it removed as shown in FIG. 3.

FIG. 3 illustrates the separating wire harness 36 in the broken or separated position where the primary mount has failed. Both the non-separating wire harness 37 and support cable 38 are shown in a tensioned position where the support cable provides support to the appliance 10. Because the weight of the appliance 10 is greater than the friction holding the connection 42 together, the connection 42 has separated when the appliance 10 fell until stopped by the secondary support cable 38. Because the connection 42 is broken, the power flowing to the appliance 10 through the wire harness 36 is interrupted, and power is no longer provided by wire harness 36 to the appliance 10.

The electrical connection 42 is comprised of two portions 48 and 50. In some embodiments of the invention the portions may be a two parts of a plug. One portion may be a male portion 48 and the other portion may be a female portion 50. In some embodiments of the invention, the connector 42 may be have prongs 52. Alternatively, as shown in FIG. 1, the connector 42 may be a pin connector with a pin connection 44 that slides inside the second receiving pin connection 46. The pin connectors 44 and 46 may be disconnected by sliding the pin connection 44 out of pin connector 46 other suitable connections 42 may be used in accordance with the invention.

In some embodiments of the invention, the separating wire harness 36 comprises of a single wire which is a hot wire providing power to the appliance 10. In instances where the separating wire harness 36 comprises a single hot wire, the non-separating wire harness 37 may comprise of a ground wire and a neutral wire or a ground wire.

In another embodiment of the invention the separating wire harness 36 may include a hot wire and neutral wire. Where two wires are used as the separating wire harness 36, and plug type connectors are used 50 and 48, two prongs 52 may be used where, one prong 52 correspond, to a hot wire and the other prong 52 to a neutral wire. In such a case, the non-separating wire harness 37 may include the ground connection.

Some embodiments of the invention may include no non-separating wire harness 37, as it is an optional element. However, the non-separating wire harness carrying a ground connection to the appliance 10 it is present in preferred embodiments of the invention. In other embodiments of the invention, the separating wire harness 36 may include all three wires ground hot and neutral. Exact configuration of what wires are used in the separating wire harness 36 and the non-separating wire harness 37, if one is used at all, is a design choice and may be made by one skilled in the art having reviewed this disclosure and familiar with the individual needs of a particular installation.

While the figures show pin connectors 44 and 46 and plug connectors 48 and 50 other types of breakable or separating connections suitable for the purpose described herein, maybe used in accordance with the invention.

Although an example of the appliance shown is a ceiling fan, it will be appreciated that other appliances may be equipped in accordance with the invention. Examples include, but are not limited to, lights, speakers, heaters, smoke alarm detectors (in which case they may be configured to cause an alarm to sound or lights to flash or a combination of both when an electrical connection is broken one to alert operators or maintenance personnel that service on the appliance is required.

While the embodiment shown and described illustrates the separating connector 42 located in the down rod 20, the connector could be located any suitable location, for example, it could be located in the mount housing 18 or motor housing 24. In general, the connector 42 can be located anywhere between a power inlet to the appliance and the power consuming portion of the appliance.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An electrical appliance comprising:

a mount configured to mount the appliance to a support structure wherein the mount has a down rod;

a support cable configured to have a slack position and a tensioned position the cable having an end proximate to the mount and another end configured to support the appliance when the cable is in the tensioned position;

electrical wiring running substantially along the length of the cable and configured to provide an electrical connection between an energy consuming portion of the appliance and an external source; and an electrical connection located within the electrical wiring and configured to provide an electrical connection to the power consuming part of the appliance when the cable is in the slack position, and the electrical connection is configured to not provide an electrical connection to the power consuming part of the appliance when the cable is in the tensioned position, wherein at least a portion of the cable and electrical wiring are contained inside the down rod, and wherein the electrical connection is entirely contained inside the down rod.

2. The appliance of claim 1, wherein the cable is configured to support the appliance when in the tensioned position.

3. The appliance of claim 1, wherein the appliance is at least one of a ceiling fan and a light.

4. The appliance of claim 1, wherein the mount comprises a J-hook.

5. The appliance of claim 1, further comprising a clamp clamping the electrical wiring to the cable.

6. The appliance of claim 1, wherein the electrical connection comprises a plug.

7. The appliance of claim 1, wherein the electrical connection comprises a pin connector.

8. The appliance of claim 1, wherein the appliance is a ceiling fan, and the cable, the electrical wiring, and the electrical connection are located in a down rod portion of the ceiling fan and configured such that if the mount fails, at least a portion of the ceiling fan will fall a distance until slack is taken up in the cable at which point the cable will support at least a portion of the ceiling fan and the electrical connection be disconnected and no power will be transmitted to a motor portion of the ceiling fan.

9. The appliance of claim 1, wherein the electrical connection comprising a two-piece electrical connection and both pieces of the electrical connection are entirely contained inside the down rod when the cable is in the tensioned position.

10. The appliance of claim 1, wherein the electrical wiring comprises a hot wire, a neutral wire and a ground wire.

11. The appliance of claim 10, wherein at least one of the hot wire and the neutral wire are associated with the electrical connection and configured to provide an electrical connection to a power consuming part of the appliance when the cable is in the slack position, and to not provide an electrical connection to the power consuming part of the appliance when the cable is in the tensioned position.

12. An electrical appliance comprising:

means for mounting the appliance to a support structure and having a down rod;

flexible elongated secondary supporting means configured to have a slack position and a tensioned position and having an end proximate to the mounting means and another end configured to support the appliance when the secondary supporting means is in the tensioned position;

means for transmitting electrical power running substantially the length of the secondary support means and configured to provide an electrical connection between an energy consuming portion of the appliance and an external source; and means for providing an electrical connection to the power consuming part of the appliance located within the means for transmitting electrical power, the electrical connection means configured to provide the electrical connection when the supporting means is in the slack position, and the means for providing an electrical connection is configured to not provide an electrical connection to the power consuming part of the appliance when the supporting means is in the tensioned position, wherein at least part of the secondary supporting means and the transmitting means are contained inside the down rod, and wherein the electrical connection means is entirely contained inside the down rod.

13. The appliance of claim 12, wherein the appliance is at least one of a ceiling fan and a light.

14. The appliance of claim 12, wherein the appliance is a ceiling fan, and the supporting means, the electrical transmitting means, and the means for providing a electrical connection are configured such that if the mounting means fails, at least a portion of the ceiling fan will fall a distance until slack is taken up in the supporting means at which point the supporting means will support at least a portion of the ceiling fan and the means for providing an electrical connection be disconnected and no power will be transmitted to a motor portion of the ceiling fan.

15. The appliance of claim 12, wherein the electrical connection means comprises a two-piece electrical connection means, and both pieces of the electrical connection means are entirely contained inside the down rod when the cable is in the tensioned position.

16. A method of cutting off power to an appliance comprising:

supporting the appliance with a down rod supplying the appliance with a secondary support cable and configuring the cable to be slack when the cable is not supporting the appliance and configuring the cable to be taut when the cable is supporting the appliance; and electrically connecting with electrical wiring a power consuming portion of the appliance with a power source when the cable is slack, and breaking the electrical connection when the cable is taut, using an electrical connection located within the electrical wiring and configured to provide an electrical connection to the power consuming part of the appliance when the cable is in the slack position, and the electrical connection is configured to not provide an electrical connection to the power consuming part of the appliance when the cable is in the tensioned position, wherein at least a portion of the cable and electrical wiring are contained inside the down rod, and where the electrical connection is entirely contained inside the down rod.

17. The method of claim 16 further comprising clamping at least one wire to the cable.

18. The method of claim 16 wherein the appliance is a ceiling fan.

19. The method of claim 16, wherein breaking the electrical connection comprises breaking a connection of at least one of a hot wire and a neutral wire.

20. The method of claim 16, wherein breaking the electrical connection does not comprise breaking a connection of a ground wire to the power consuming portion of the appliance.

21. The method of claim 16, further comprising housing at least one of the cable and a electrical wire in a down rod.

* * * * *